US008615993B2

(12) United States Patent
Berchowitz et al.

(10) Patent No.: US 8,615,993 B2
(45) Date of Patent: Dec. 31, 2013

(54) BEARING SUPPORT SYSTEM FOR FREE-PISTON STIRLING MACHINES

(75) Inventors: David M. Berchowitz, Athens, OH (US); Yong-Rak Kwon, Athens, OH (US)

(73) Assignee: Global Cooling, Inc., Athens, OH (US)

( * ) Notice: Subject to any disclaimer, the term of this patent is extended or adjusted under 35 U.S.C. 154(b) by 434 days.

(21) Appl. No.: 12/872,381

(22) Filed: Aug. 31, 2010

(65) Prior Publication Data

US 2011/0056196 A1 Mar. 10, 2011

Related U.S. Application Data

(60) Provisional application No. 61/241,081, filed on Sep. 10, 2009.

(51) Int. Cl.
*F02G 1/043* (2006.01)

(52) U.S. Cl.
USPC ..... 60/520; 60/517

(58) Field of Classification Search
USPC ..... 60/520; 90/160, 140; 384/12
See application file for complete search history.

(56) References Cited

U.S. PATENT DOCUMENTS

| | | | | |
|---|---|---|---|---|
| 3,402,735 | A * | 9/1968 | Kates | 137/501 |
| 5,140,905 | A * | 8/1992 | Dhar | 92/82 |
| 5,522,214 | A | 6/1996 | Beckett et al. | |
| 5,525,845 | A | 6/1996 | Beale et al. | |
| 5,642,618 | A * | 7/1997 | Penswick | 60/520 |
| 5,920,133 | A | 7/1999 | Penswick et al. | |
| 6,293,184 | B1 | 9/2001 | Unger | |
| 2003/0221427 | A1 | 12/2003 | O'baid et al. | |
| 2005/0120721 | A1 | 6/2005 | O'Baid et al. | |
| 2005/0244290 | A1 | 11/2005 | Inagaki et al. | |
| 2007/0157801 | A1 * | 7/2007 | Hanes | 92/127 |
| 2009/0217658 | A1 * | 9/2009 | Fiedler | 60/519 |

* cited by examiner

*Primary Examiner* — Thomas Denion
*Assistant Examiner* — Jessica Kebea
(74) *Attorney, Agent, or Firm* — Frank H. Foster; Kremblas & Foster

(57) ABSTRACT

A bearing support system for a piston and its connecting rod in which the bearing system supports the combined piston and connecting rod by only two bearings, a gas bearing at the piston and a radially acting spring bearing at its connecting rod. A non-compliant connecting rod is fixed to an end of a piston which has a clearance seal length in the range of 0.3 times the diameter of the piston and 1.5 times the diameter of the piston. The distance from the gas bearing to the effective point of connection of the radially acting spring bearing to the connecting rod is greater than the seal length of the piston. The piston and connecting rod unit is not supported by additional bearings that introduce additional alignment problems.

9 Claims, 4 Drawing Sheets

Fig. 1 Prior Art
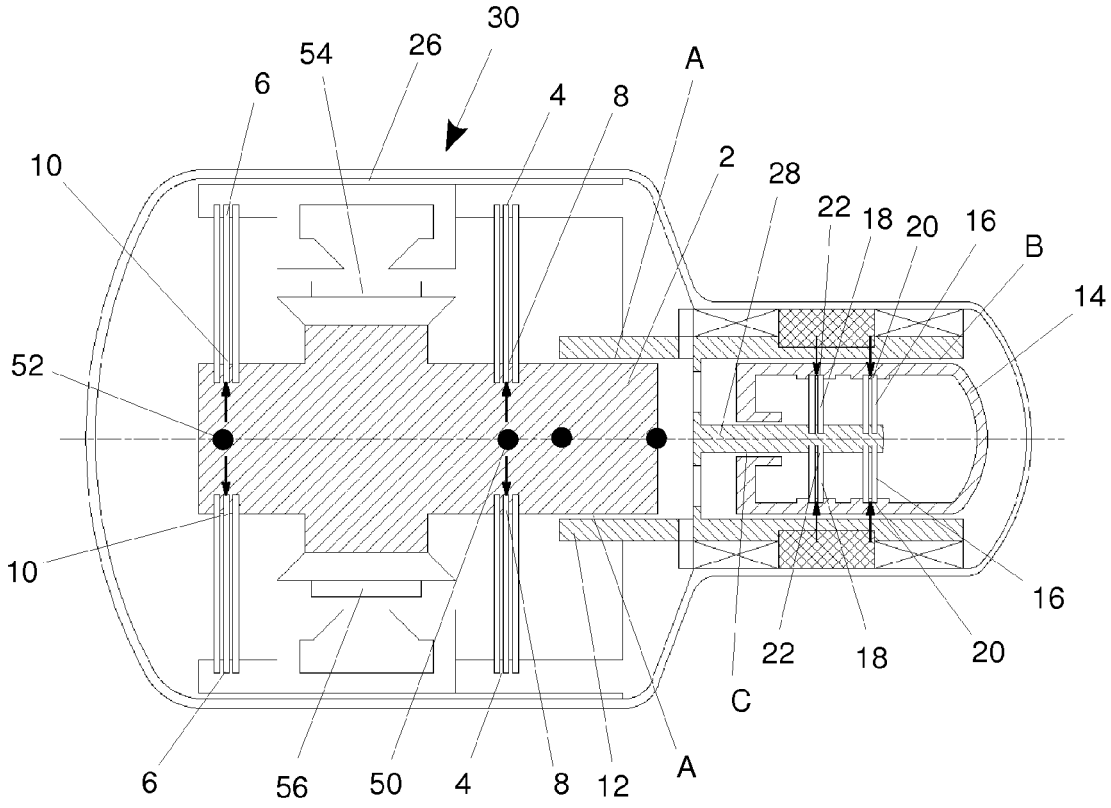
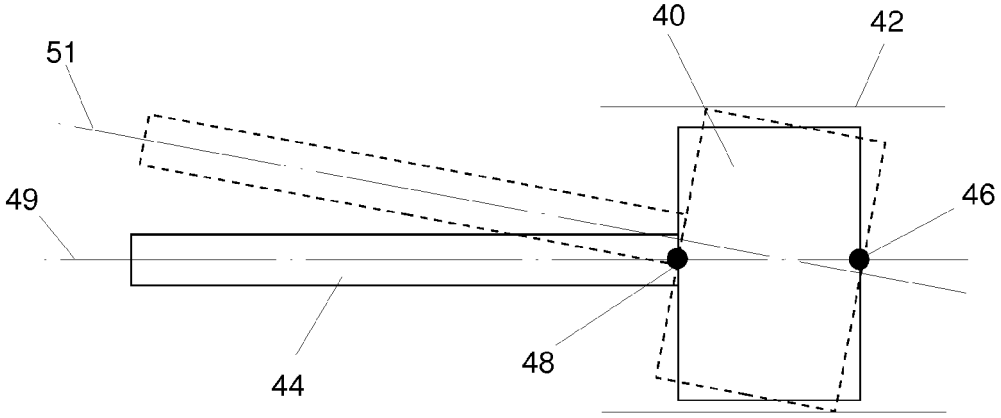
Fig. 2

Fig. 3 Prior Art
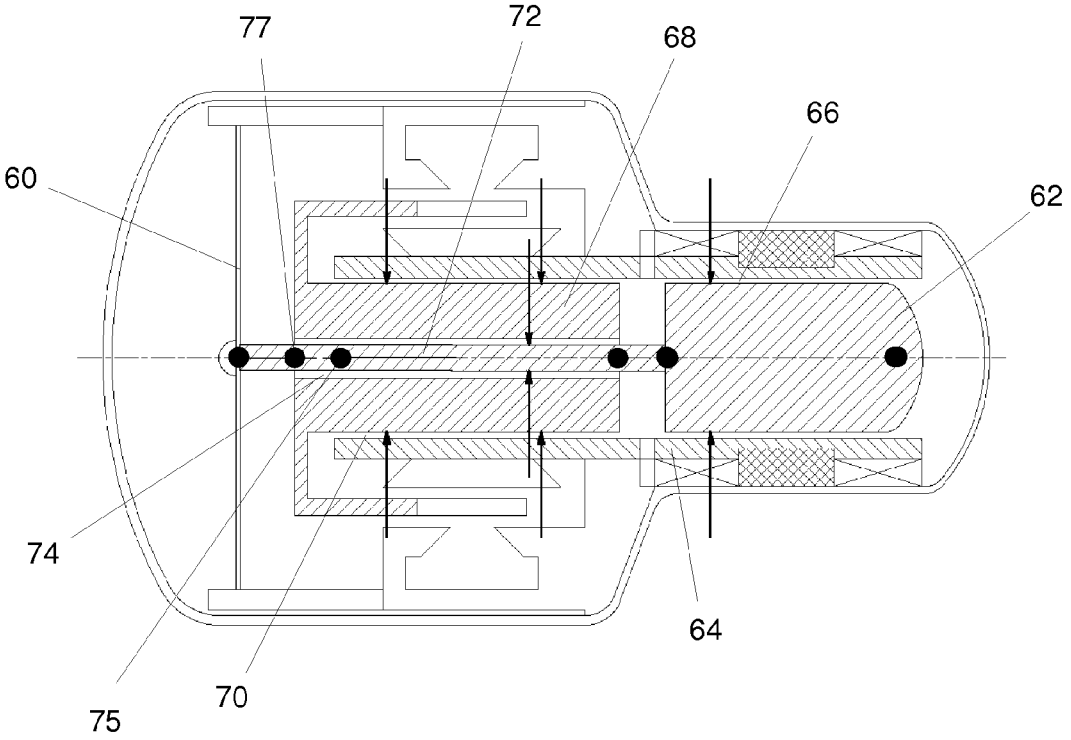
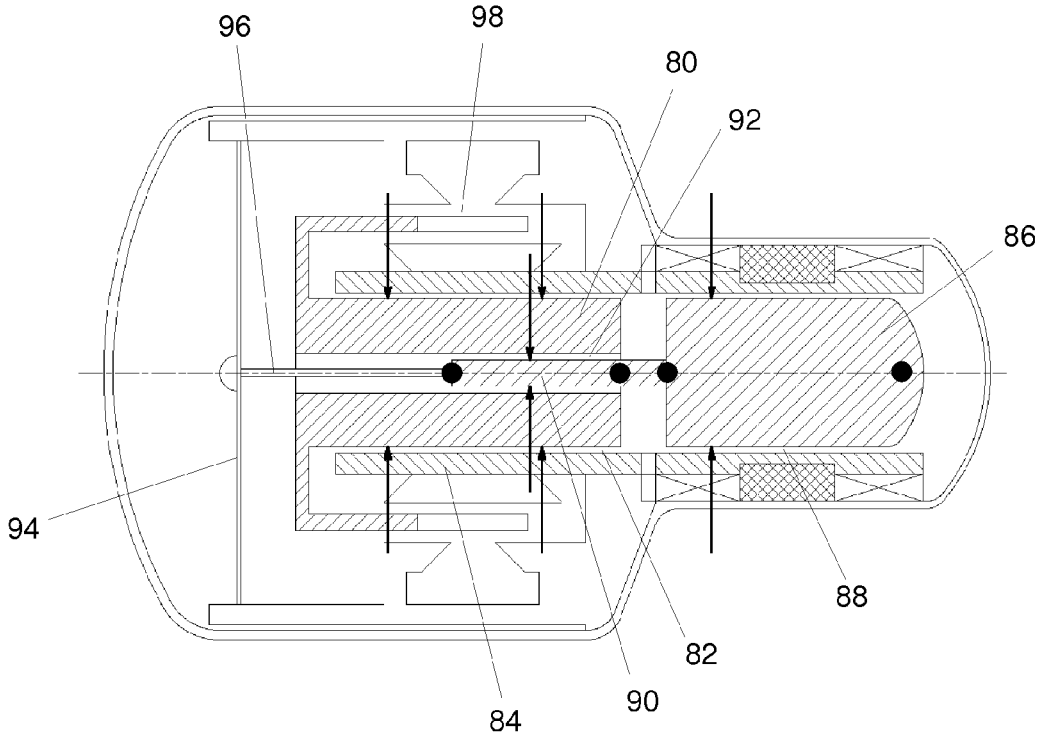
Fig. 4 Prior Art

Fig. 5
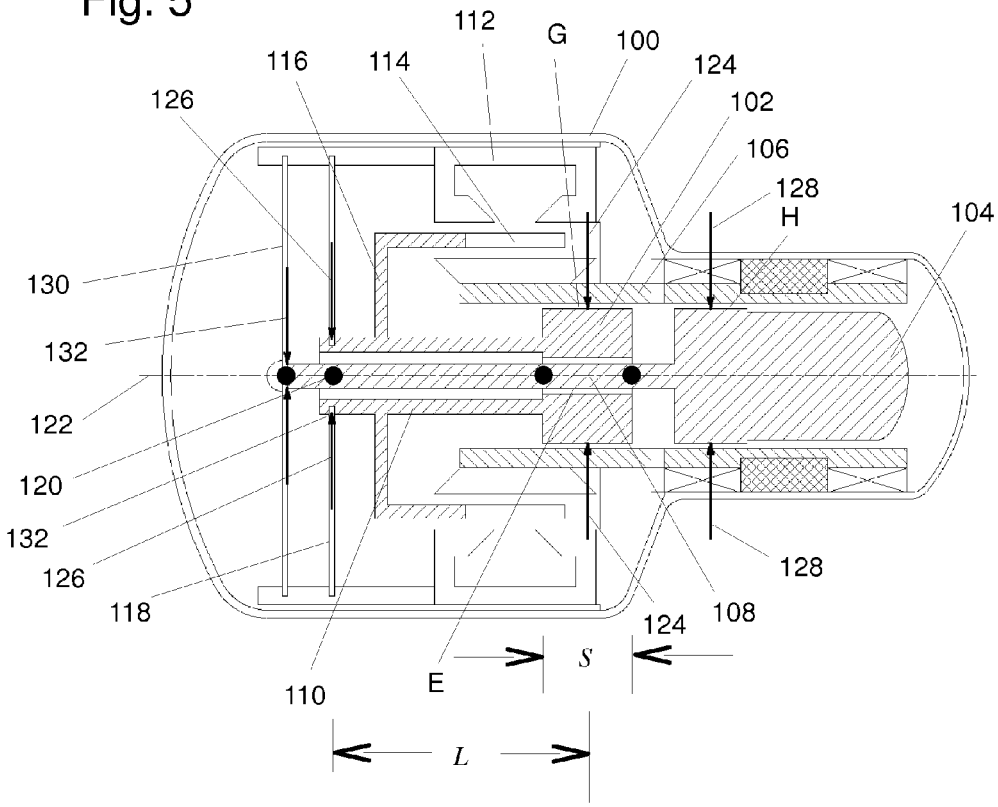
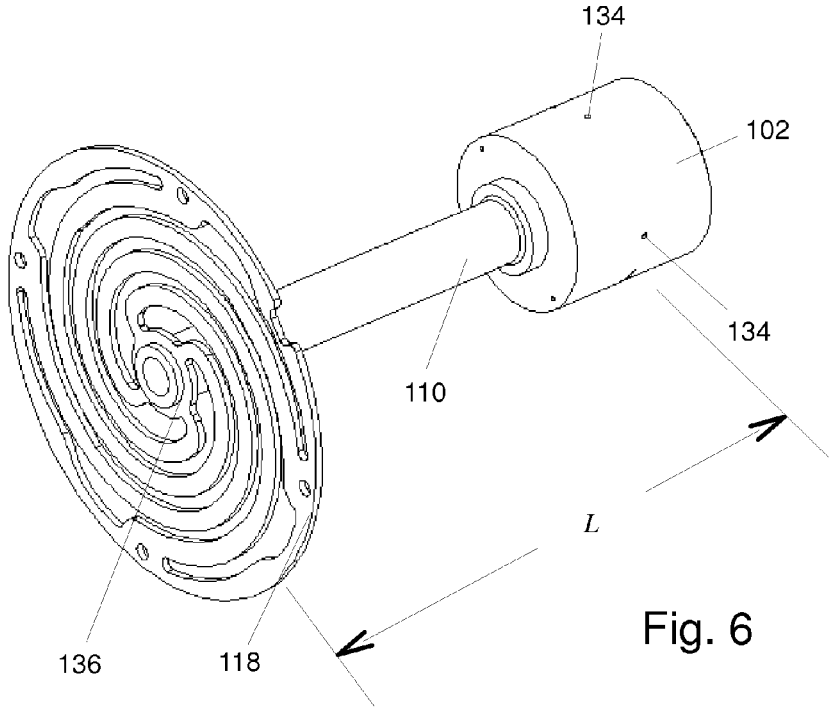
Fig. 6

Fig. 7
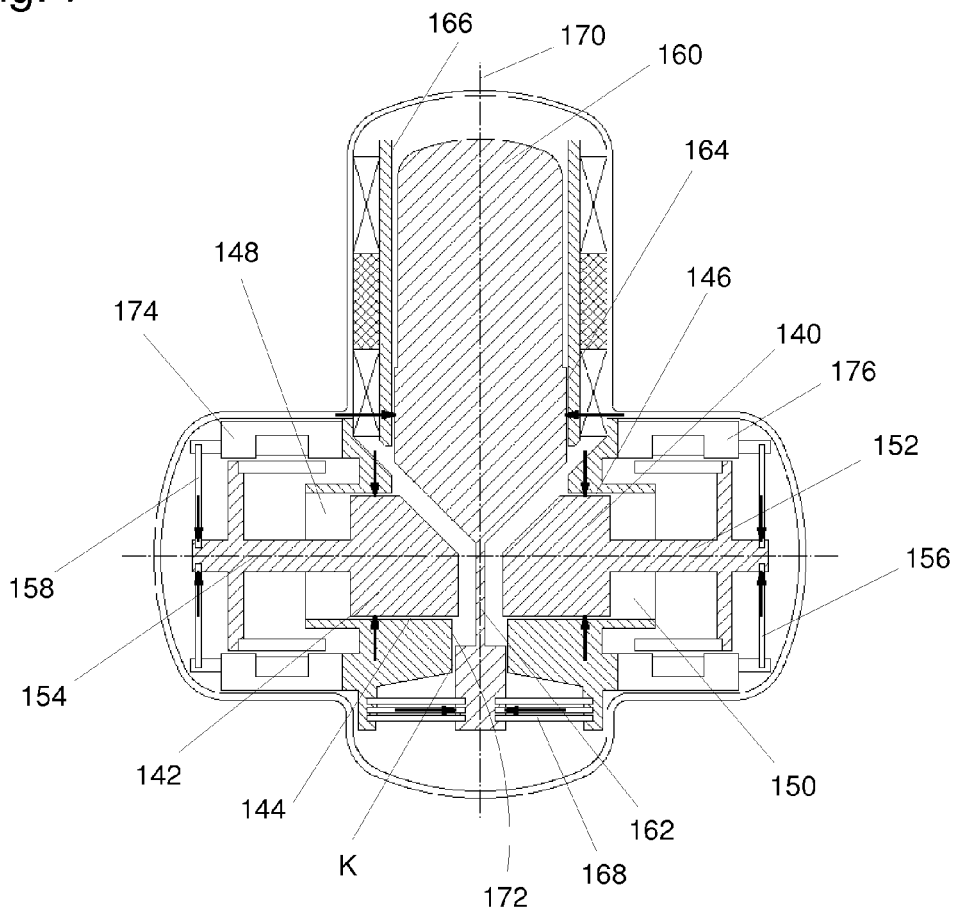
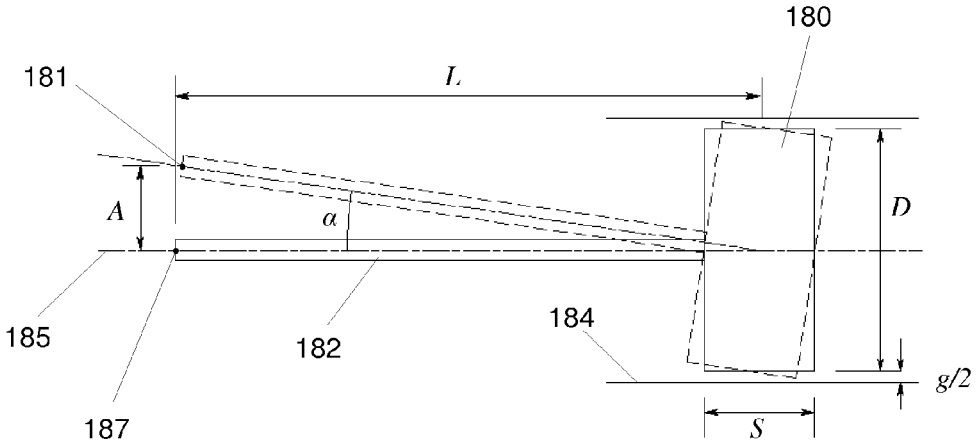
Fig. 8

BEARING SUPPORT SYSTEM FOR FREE-PISTON STIRLING MACHINES

BACKGROUND OF THE INVENTION

This invention relates generally to free-piston Stirling machines and more particularly relates to non-contact bearing support systems that support their power piston and/or displacer piston and their respective connecting rods attached to them. The invention improves the life, reliability and cost of free-piston machinery by providing a simple and reliable means to implement non-contact bearings in a manner that reduces the difficulty of aligning the bearings or allows more accurate alignment or both.

Although free-piston Stirling cycle machines have been shown in the prior art in a very extensive variety of configurations, most have a displacer piston and a power piston that reciprocate in the same cylinder or in different cylinders. An end of the power piston and often an end of the displacer piston is ordinarily rigidly fixed to a connecting rod that reciprocates with the piston. These components together as a unit are supported within a casing of the Stirling machine. The casing contains a working gas that alternately expands and compresses as the working gas is shuttled between an expansion space and a compression space.

Stirling machines are designed to provide either: (1) an engine having a power piston and displacer piston driven by applying an external source of heat energy to the expansion space and transferring heat away from the compression space and therefore capable of being a prime mover for a mechanical load, or (2) a heat pump having the power piston (and sometimes the displacer piston) cyclically driven by a prime mover for pumping heat from the expansion space to the compression space and therefore capable of pumping heat energy from a cooler mass to a warmer mass. The heat pump mode permits Stirling machines to be used for cooling an object in thermal connection to its expansion space, including to cryogenic temperatures, or heating an object, such as a home heating heat exchanger, in thermal connection to its compression space. Therefore, the term Stirling "machine" is used to generically include both Stirling engines and Stirling heat pumps, the latter sometimes being referred to as coolers. Both Stirling engines and Stirling heat pumps, like electromagnetic motors and generators or alternators, are both basically the same power transducer structures capable of transducing power in either direction between two types of power.

In order to minimize the frictional wear of the reciprocating components of a free-piston machine, it is desirable to avoid contact between the reciprocating bodies and their cylinders or other supports within the casing. Conventional lubricants cannot be used for this purpose because they substantially degrade the properties of the working gas and result in a substantial decrease in the efficiency of the free-piston Stirling machine. For these reasons, free-piston Stirling cycle machines commonly use gas bearings and also radially acting spring bearings, such as planar springs. Although both kinds of bearings are known in the art, some explanation of gas bearings and radially acting spring bearings is desirable because some aspects of their operation are relevant to the invention.

A bearing is a device that supports, guides, and reduces the friction of motion between at least two parts that move with respect to each other. A bearing supports the two parts in a relative position or orientation with respect to each other but permits one part to move with respect to the second part in one or more directions of motion. It is often desirable to minimize the friction between the parts and minimize the force applied by one part to the other in the permitted directions of motion. A "non-contact bearing" supports the parts in a manner that the parts themselves that are moving relative to each other do not come into contact. The bearing itself, such as a planar spring bearing, may contact both parts, but it does not rub or slide against either part.

A gas bearing is one type of non-contact bearing that is often used on free-piston Stirling machines to maintain the separation of a piston in a cylinder or a connecting rod in a cylindrical bore. The gas bearing uses a gas, typically the working gas, that is pumped between relatively moving surfaces and functions as a lubricant to maintain separation of the relatively moving surfaces. Gas bearing systems have a fluid flow loop in which working gas is pumped out of ports in the piston or cylinder into the clearance gap between the piston and cylinder. To construct an effective gas bearing, the clearance fit between the two moving surfaces must be a close fitting clearance and the distance range of that clearance for a gas bearing in a Stirling machine is known to those skilled in the art. There must be at least three such ports spaced around the cylindrical periphery, preferably equi-angularly (every) 120°, so that there will be radially inwardly directed centering forces applied toward centering the piston regardless of the radial direction in which the piston may become off center. Because gas bearings require close fitting clearances, if a cylindrical surface of one body has a close fit clearance with a cylindrical surface of another body because there is a gas bearing between them, the axes of the two cylindrical surfaces must be aligned to avoid contact.

A close fit clearance between a cylindrical surface of one body with a cylindrical surface of another body can also provide a "clearance seal". It is commonly desirable to provide a seal between two parts, such as a piston and the associated cylinder in which it reciprocates. The seal is intended to prevent or minimize the flow of a fluid between the piston and cylinder from one end of the piston to the other. However, it is desirable to simultaneously prevent contact between the piston and its cylinder in order to prevent wear and therefore gas bearings are used. Although not perfect, the clearance between the piston and its cylinder can be made sufficiently small to provide both reasonably effective sealing as well as a non-contact bearing. Such a seal using a small clearance fit is a clearance seal. The "seal length" of a clearance seal may be defined as the effective length in the axial direction of the portion of the piston's cylindrical periphery that is formed as the clearance seal; that is, the close fit clearance portion. Most commonly, that is the entire length of the piston. However, if the piston at times is displaced along the cylinder to a position where it protrudes from the cylinder, then the effective seal length of the clearance seal is shortened slightly and more particularly is the time averaged length of the clearance seal interface between the piston and its associated cylinder. The "axial center" of the clearance seal may be defined as the center, along the axial direction, midway between the axially opposite ends of the clearance seal. That midway position is the axial center and can be used to define the position of the clearance seal.

A radially acting spring bearing is another type of non-contact bearing that has been used on free-piston Stirling machines. Although the term "radially acting spring bearing" is not commonly used, it has been adopted because it is believed to best describe one of the bearings that is used in embodiments of the invention. A "radially acting spring bearing" is a spring that is connected to each of the two bodies that are to be supported in a non-contact relationship with one body moving with respect to the other. This bearing applies its spring force in a radial direction opposite its radial direction of deflection from its central axis when it is deflected away from its relaxed condition at the central axis. Its spring force in a radial direction is 0 for no deflection from its axis which means that it introduces no side loading. It can additionally apply a spring force in an axial direction so that it has two components of spring force, axial and radial. So a radially acting spring bearing is a spring that has a component of force in the radial direction, applies no radial force when centered and its force in the axial direction can be 0 or finite. For the invention, it should apply no significant net side forces as it is deflected.

An example of a commonly used radially acting spring bearing that is known in the prior art is a planar spring. A planar spring typically has arms extending from a central hub to an outer rim along a spiral-like or involute-like path. The arms, hub and rim are usually in a plane in their relaxed state. Typically the arms have a width in the plane considerably greater than their thickness perpendicular to the plane. Planar springs used as bearings are very stiff for deflection in the radial direction, but also apply a spring force, with far less stiffness, when deflected in the axial direction.

A common coil spring, in which a wire is wound as a helix, cannot be used as a radially acting spring bearing if oriented in an axial direction because it applies significant side forces when deflected axially. However, it would be possible to use several radially oriented coil springs arranged along radials of an axis of reciprocation as a radially acting spring bearing. Also usable is a spiral or involute spring, similar to a planar spring and typically constructed of spring wire wound in a plane along a spiral-like pattern, with connections to the other machine components at the innermost, centrally located end of the wire and at the outermost peripheral part of the wire. A conical coil spring might also be used but risks the introduction of side loads like the coil spring.

Great effort has been expended in the prior art in order to avoid oil-type lubricants to prevent wear of the internal components of Stirling cycle engines and coolers while avoiding contamination of the working gas. The free-piston configuration greatly reduces side loads because the free-piston configuration does not use a motion translating mechanism that introduces side loads, such as a connecting rod connected to a crankshaft. However, it is still necessary to provide bearing support for a reciprocating part in order to avoid excessive wear. Two techniques in the prior art have found common application to solve the problem of supporting a free piston that has a close fit clearance in a manner that avoids contact between the close fit surfaces and yet allows reciprocation of the piston.

The first technique, referred to as flexural bearing support (e.g. U.S. Pat. No. 5,920,133, Penswick et al and U.S. Pat. No. 5,522,214, Beckett et al), is to support the moving components entirely on planar springs so that there is no contact between the cylinder and the moving component (power piston or displacer piston). This bearing support system is shown in FIG. 1 implemented on a posted-displacer configuration free-piston Stirling machine. A piston 2 is supported by flexures 4 and 6 at points 8 and 10 on the piston 2 so that close-fitting clearance A is maintained with cylinder 12. The displacer 14 is similarly supported by flexures 16 and 18 at points 20 and 22 so that close-fitting clearances B and C are maintained. All of these flexures are planar springs. Flexures 4 and 6 are securely held on support structure 24 so that there is essentially no radial motion while providing limited axial motion. The support structure 24 is fixed to the casing 26 so that the peripheral rim portion of the flexures 4 and 6 are effectively fixed to the casing 26. "Fixed to the casing" means attached directly or indirectly in a fixed position relative to the casing because a component part can be fixed to an interposed structure that is itself fixed to the casing. Flexures 16 and 18 are supported peripherally on the displacer 14 and at their centers on the displacer rod 28. The displacer rod 28 is rigidly attached to the cylinder 12 which in turn is fixed to the casing 26. A linear alternator/motor 30 provides electrical output or mechanical input depending on whether the free-piston machine is an engine or a heat pump, respectively. The casing 26 is hermetically sealed and contains the moving parts.

The problem with the prior art of FIG. 1 is that the flexures 4 and 6 must be precisely aligned so that the power piston 2 is unable to make contact with the cylinder 12. Similarly, the flexures 16 and 18 must be precisely aligned so that the displacer piston 14 is unable to make contact with the cylinder 12. Furthermore, the flexures must be sufficiently stiff to support the piston weight if the machine runs with a non-vertical axis of reciprocation in a gravitational field and to support the pistons against other side loads.

The difficulty of this problem of alignment is illustrated in FIG. 2 which is a diagram showing a piston 40 that reciprocates in a cylinder 42. The clearance is greatly exaggerated in order to illustrate the applicable principles. The piston 40 has a connecting rod 44 fixed coaxially to an end of the piston. As used in this description, a "connecting rod" is an essentially rigid link connecting a piston to another component. Commonly, a connecting "rod" is a solid cylindrical rod but it is not necessary that the connecting rod be a solid material throughout its cross section and it is not necessary that it have a cylindrical peripheral surface or even a symmetrical outer peripheral surface when viewed in cross section. For example a connecting rod can be a tube and or have an I-beam or L-beam cross-section. Therefore the term "rod" is used but is not limited to a solid rod but includes other shapes of rigid connecting arms, including multiple smaller arms that together act mechanically as a single connecting arm. Ordinarily, the connecting rod is connected to an axially reciprocating load that is driven by the Stirling machine or a prime mover that drives the Stirling machine. Since it is desirable to minimize the volume of a machine, the "connecting rod" of a power piston can have components of the load or prime mover mounted to it in such a manner that a separate connecting rod is not readily apparent. That is the case with the structure of FIG. 1 in which the reciprocating magnets 54 and 56 of the linear alternator or motor are mounted to a connecting rod that has the same diameter as the piston 2 and is not visibly distinguishable from the piston, although it is functionally distinguishable. Furthermore, the "connecting rod" of FIG. 1 also connects the piston to two flexures 4 and 6 and has a component of the linear alternator/motor interposed between its ends. All these characteristics can be characteristics of a connecting rod.

As seen in FIG. 2, the proper alignment of the piston 40 in the cylinder 42 requires that two points, 46 and 48, be accurately positioned. One point is the intersection of the axis of the piston and a plane perpendicular to the axis at one end of the piston (or more concisely at one end of the close fit clearance). The second point is the intersection of the axis of the piston and a plane perpendicular to the axis at the opposite end of the piston (or more concisely at the opposite end of the close fit clearance). The rightmost two black dots in FIG. 1 illustrate the corresponding points for the embodiment of FIG. 1. Those two intersection points must both be positioned on or very near the axis 49 of the cylinder 42 in order to avoid contact of the outer periphery of the piston with the surface of its cylinder. However, as illustrated in FIG. 2, any rotation of the piston 40 and its connecting rod 44 away from coaxial alignment also moves the axis 51 of the connecting rod 44 radially away from the axis 49 of the cylinder 42. At some sufficient angle of misalignment, the peripheral surface at one or both ends of the piston 40 will contact the cylinder 42 as illustrated by dashed lines.

Referring again to FIG. 1, an extension of the piston 2 protrudes out of the cylinder 12 and into the reciprocating component of the electric linear motor or alternator. That extension functions as a connecting rod which couples the motion of the piston 2 of the Stirling machine to the linear motor/alternator. Because that connecting rod is displaced off-center by any misalignment of the piston, in the structure of FIG. 1, it is necessary to simultaneously align two additional points 50 and 52 along the axis of the cylinder 12. Those two additional points 50 and 52 are the intersection 50 of the axis of the piston 2 with a plane perpendicular to that axis at the attachment point of the flexure 4 to the piston 2 and the intersection 52 of the axis of the piston 2 with a plane perpendicular to that axis at the attachment point of the flexure 6 to the piston 2. The problem solved by the invention arises because of the difficulty of obtaining accurate alignment of four points symbolized by the four black dots in FIG. 1. The problem is that radial adjustment of any one point moves the radial position of at least two of the three other points. Of course only the positions of the two flexures 4 and 6 can be manipulated in the alignment procedure. But the movement of one always affects the required position of the other. So the adjustment procedure always requires going back and forth between the two flexure adjustments and is difficult and time consuming to accomplish satisfactory alignment.

FIG. 3 illustrates a beta free-piston Stirling machine with gas bearings, indicated by radially inwardly directed arrows, and with a planar spring 60 as a bearing. A displacer piston 62 reciprocates in a cylinder 64 and has a close fit clearance 66 that is needed for its gas bearing. A power piston 68 reciprocates in the cylinder 64 and is separated from it by a gas bearing formed at the close fit clearance 70. A connecting rod 72 is fixed at one end to the end of the displacer piston 62 and at its opposite end to a planar spring bearing 60. The connecting rod 72 has a cylindrical exterior and extends through a cylindrical bore axially through the piston 68. A gas bearing is formed at the close fit clearance 74 between the connecting rod 72 and the piston 68.

For the displacer piston 62 and its connecting rod 72, there are five points that must be aligned and they are illustrated by the large black dots, not including point 75. There are two points for the gas bearing at the close fit clearance 66, for the reasons explained above, two points for the gas bearing at the close fit clearance 74 and one point for the planar spring bearing 60. For the piston 68 there are five points that must be aligned not including point 77, two for the gas bearing at the close fit clearance 74, two for the gas bearing at the close fit clearance 70 and one point for the planar spring bearing 60.

In order to alleviate the problem of aligning five points, the prior art discloses an implementation of gas bearings with compliance built into the connecting rod as illustrated in FIG. 4 for a beta free-piston Stirling machine. A piston 80 is supported by gas bearings at close-fitting clearance 82 between the piston 80 and the cylinder 84. A displacer piston 86 is similarly supported in the cylinder 84 by gas bearings at the close fitting clearance 88. A connecting rod 90 is connected to the end of the displacer piston 86 and is supported by a gas bearing at close-fitting clearance 92 along the interfacing exterior of the connecting rod 90 and the interior of the axial bore through the piston 80. In order to avoid excessive side-loads and/or assembly tolerance stack-up, the planar spring 94 is connected to the displacer rod 90 by way of flexure rod 96 which is a compliant member. As in the devices of FIGS. 1 and 3, a linear alternator/motor 98 provides electrical output or mechanical input depending on whether the machine is an engine or a heat pump.

As in FIG. 3, the power piston 80 is supported on gas bearings at its peripheral, cylindrical surface, the displacer piston 86 is supported on gas bearings at it peripheral surface and on the displacer connecting rod 90 where the connecting rod 90 is within the piston 80. The compliant member 96 is used to connect the displacer rod 90 to the planar spring bearing 94. The planar spring 94 may provide additional radial compliance to reduce side loads on the displacer due to constructional inaccuracies. The basic concept of using a compliant flexure rod 96 to connect the end of the connecting rod 90 to the planar spring bearing is that the point of the attachment of the compliant flexure rod 96 to the planar spring bearing is not as critical because the machine can operate with the compliant flexure rod 96 in a slightly bent condition without introducing excessive side loading. Therefore, less accurate positioning of that attachment point can be tolerated. Nonetheless, there remain four points that must be aligned as illustrated by the black dots on FIG. 4.

The chief difficulty of this arrangement is that in order to obtain satisfactory stiffness on the displacer rod gas bearing, a very close fit of less than 25 μm diametrical clearance is required with the bore in the piston. In some cases, particularly smaller machines where the rod may be only around 3 to 5 mm in diameter, the clearance may be as small as 8 to 15 μm. This places a requirement of precision that cascades through the structure resulting in further precision requirements of concentricity, straightness and perpendicularity.

The flexural system of FIG. 1 is highly limited in amplitude and requires substantial space for implementation and is therefore associated with bulky configurations. The planar spring bearings 4, 6, 18 and 20 must be sufficiently stiff to support the piston weight if the machine runs on its side in a gravitational field (i.e. with its axis not vertical) and other side loads. Furthermore, since the planar springs are responsible for holding the clearance between the moving part and its cylinder, an extraordinary level of precision is required for the components and their assembly. The conventional gas bearing technique of FIG. 4 has a more relaxed precision but suffers from very feeble support on small diameters, e.g., the displacer rod on free-piston Stirling machines. Thus, a requirement of this technique is to employ compliance so that other components attached to the moving parts (mechanical springs, for example) will not overcome the gas bearing load capacity (e.g., U.S. Pat. No. 5,525,845, Beale et al).

The above description demonstrates that the bearing systems that have been shown in the prior art require a high degree of precision in the machining of parts and a high degree of precision in the alignment of parts or are limited by very feeble support of gas bearings on small diameters. The purpose of the invention is to reduce the degree of precision required for alignment while maintaining the other favorable characteristics of non-contact bearings.

An ideal bearing system for piston-cylinder assemblies, particularly for use in free-piston machinery, would have the following attributes in addition to non-contact operation:

a. No greater precision required than that for satisfactory performance from the machine. That is, the bearing system should minimize the requirement of additional precision components.
b. The bearing system should require no end-loop adjustments during manufacture.

c. The bearing system should be robust so that there is no possibility of the bearings going out of adjustment over time.

d. The bearing system should be able to tolerate a reasonable level of external shock or component over stroke without becoming misaligned.

The proposed invention has these advantages over current systems.

BRIEF SUMMARY OF THE INVENTION

Most simply stated, the invention is a bearing support system for a piston and its connecting rod in which the bearing system supports the combined piston and connecting rod by only two bearings, a gas bearing at the piston (or displacer) and a radially acting spring bearing at its connecting rod, preferably with a spacing between them within described limits and preferably with a spacing that exceeds a calculated value based upon chosen engineering parameters.

In more detail, a non-compliant connecting rod is fixed to an end of a piston which has a clearance seal length in the range of 0.3 times the diameter of the piston and 1.5 times the diameter of the piston. The piston and the connecting rod together are supported in a casing by two bearings. One of the two bearings is a gas bearing formed at the interface between the selected piston and its associated cylinder. The second bearing is a radially acting spring bearing fixed to the casing and extending to fixed connection to the connecting rod. The distance from the gas bearing to the connection of the radially acting spring bearing to the connecting rod is greater than the seal length of the piston. The piston and connecting rod unit is not supported by additional bearings that introduce additional alignment problems.

BRIEF DESCRIPTION OF THE SEVERAL VIEWS OF THE DRAWINGS

FIG. 1 is a diagram in axial section of a prior art Stirling machine having a piston and its connecting rod supported by two flexures with a piston having a close fit clearance.

FIG. 2 is a diagram illustrating the misalignment of a piston and its connecting rod but drawn with greatly exaggerated diametrical clearance gaps in order to illustrate the principles of the invention.

FIG. 3 is a diagram in axial section of a prior art Stirling machine having a displacer piston and its connecting rod supported by two gas bearings and a planar spring.

FIG. 4 is a diagram in axial section of a prior art Stirling machine having a displacer piston and its connecting rod supported by two gas bearings and a planar spring and using a flexure rod to connect the displacer rod to the planar spring.

FIG. 5 is a diagram in axial section of a Stirling machine embodying the invention.

FIG. 6 is a view in perspective of the piston, its connecting rod and a planar spring for the embodiment of FIG. 5.

FIG. 7 is a diagram in axial section illustrating an alternative embodiment of the invention.

FIG. 8 is a diagram showing the parameters preferably used in computing one of the parameters in a design embodying the invention, such as the distance from the gas bearing to the radially acting spring bearing but drawn with greatly exaggerated diametrical clearance gaps in order to illustrate the principles of the invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the terms connected, fixed to or other terms similar thereto are used. They are not limited to direct connection, but include connection through other elements where such connection is recognized as being equivalent by those skilled in the art.

DETAILED DESCRIPTION OF THE INVENTION

FIG. 5 illustrates a free-piston Stirling cycle machine having the improved bearing support system of the invention. The machine includes a casing 100 containing a cylindrical, free, power piston 102, a displacer piston 104 and other moving parts and is hermetically sealed to retain the working gas. Each piston is reciprocatable in a cylinder 106 mounted to the casing 100 and has a clearance seal with a seal length and an axial center. The piston 102 is supported by gas bearings at close fit clearance G in order to maintain a non-contact, close-fit with cylinder 106 and provide a clearance seal. Gas bearings are also provided at the interfaces at the close fit clearance H around the displacer piston 104 (about 25 μm diametrical clearance, typically) in order to maintain non-contact, close-fit with cylinder 106 and provide a clearance seal. In this case, the diametrical clearance E between the displacer rod 108 and the piston 102 can be more generous, for example 50 μm to 100 μm, since diametrical clearance E is intended to be a clearance and not a gas bearing.

The power piston 102 has a seal length in the range of 0.3 times the diameter of the piston to 1.5 times the diameter of the piston. A tubular, non-compliant connecting rod 110 is fixed to an end of the power piston 102. The meaning of "non-compliant connecting rod" may be explained as follows. The term "compliance" identifies the characteristic of a body, such as a connecting rod, to flex or bend when acted upon by a sideward force, without exceeding its elastic limit, without introducing excessive side forces, and without failing from fatigue over its expected useful life. As described above, the machine of FIG. 4 uses a compliant connecting rod 96 because a compliant connecting rod can operate in a deformed or bent configuration. That allows the compliance to compensate for imperfect alignment of the axis of reciprocation of a piston reciprocating in a cylinder with the axis of reciprocation of another component part that is connected to the piston by the connecting rod. However, compliance also introduces some problems as described above. Of course in the real world all materials have some compliance, particularly metals that are commonly used to construct machines. Therefore, "non-compliant" means that the compliance of the connecting rod is so small and insignificant (i.e. the connecting rod is sufficiently rigid) that the machine's operation does not depend upon, use or employ the inconsequential compliance characteristic of the connecting rod.

A linear alternator/motor 112 is supported in the casing 100. The reciprocating magnets 114 of the linear alternator/motor 112 are mounted to the connecting rod 110 by means of the radially extending magnet support 116. The linear alternator/motor 112 provides electrical output when driven by the Stirling machine operated as a Stirling engine or provides a mechanically reciprocating prime mover when the Stirling machine is operated as a cooler or heat pump.

The piston 102 and its connecting rod 110 together as a rigidly connected unit are supported in the casing 100 by two and only two bearings. The piston 102 is supported by gas bearings at the annular close fit clearance G in order to maintain a non-contact, close-fit with cylinder 106 and provide a clearance seal. The second bearing is a radially acting spring bearing 118 fixed to the casing 100 and extending to fixed connection to the connecting rod 110. The radially acting spring bearing 118 constrains the second support point 120 to the axis 122 of the machine. The axial distance L from the gas bearing at G to the place where the radially acting spring bearing 118 is connected to the connecting rod is greater than the seal length S of the piston 102. The radially acting spring bearing 118 may also serve as a spring with a spring force acting in the longitudinal, axial direction to provide the necessary resonance for reciprocation and/or the longitudinal centering force.

By arranging the distance L between the piston 102 gas bearing support points (at arrows 124) and the radially acting spring bearing 118 support points (at arrows 126) so that the distance L is a multiple of the piston seal length S, a degree of rotation (in the axial plane of the figure) of the piston 102 with its connecting rod may be tolerated at the radially acting spring bearing 118 support points thus greatly reducing the locating precision required of the radially acting spring bearing 118. Similarly, the displacer piston 104 is supported at a first support point by a gas bearing (at arrows 128). The displacer connecting rod 108 is supported by a radially acting spring bearing 130 at a second support point (at arrows 132) to constrain the second support point to the axis 122 of the machine. By arranging the distance between the displacer gas bearing support point (center of the gas bearing) so that the axial distance between the two support points for the two bearings is a multiple of the displacer seal length, a degree of rotation (in the plane) of the displacer may be tolerated thus reducing the locating precision required of radially acting spring bearing 130. The displacer rod clearance E can be set large enough so that no contact occurs between the displacer rod 108 and the piston 102 without being so large that leakage losses become too great. An alternative for the displacer rod seal E is to employ an abradable surface so that wear-in will occur until the components are self-supporting at which time, wear ceases.

FIG. 6 shows an example of the structure of the piston 102, its tubular connecting rod 110 and the radially acting spring bearing 118, which is a planar spring, all used in the embodiment of the invention that is illustrated in FIG. 5. Ports 134 are formed through the peripheral cylindrical surface of the piston 102 for the introduction of gas into the gas bearing surrounding the piston at 102 to provide non-contact support for the piston within its cylinder (not shown in FIG. 6). The distance L between the connection point 136 of the radially acting spring bearing 118 and the gas bearing around the piston 102 is much greater than the length of the piston 102, which is also the seal length for the piston 102. The greater the distance L, the less that piston alignment is affected by the distance of radial off-set of the axis of the connecting rod 110 from the axis of the cylinder at the center of attachment of the radially acting spring 118.

FIG. 7 shows another implementation of a bearing support system according to the present invention in a gamma, opposed piston configuration free-piston Stirling machine. Power pistons 140 and 142 are supported by respective gas bearings at the clearance gaps 144 and 146 in order to maintain non-contact, close-fit with cylinders 148 and 150. The connecting rods 152 and 154 are constrained at a second support point by radially acting spring bearings 156 and 158. The displacer piston 160 has a connecting rod 162 that does not penetrate either the power piston 142 or the power piston 144 so the relaxation of precision as a result of the invention is even more pronounced. In the embodiment of FIG. 7, both the power pistons 140 and 142 and also the displacer piston 160 are supported in accordance with the invention.

By arranging the distance between the two support points of the combination of a piston and its connecting rod together, so that it is a multiple of the piston seal length, a degree of rotation (in a plane containing the axis) of the piston may be tolerated thus greatly reducing the radial locating precision required of each radially acting spring bearing. Similarly, the displacer 160 is supported by a gas bearing at 164 in order to maintain non-contact, close-fit within its cylinder assembly 166 and by a radially acting spring bearing 168 that is connected to the displacer connecting rod 162 to constrain the second support point to the axis 170 of the displacer cylinder 166. The clearance K between the larger diameter portion of the displacer connecting rod 162 and its surrounding cylinder 172 is made large enough so that they do not contact without being so large that leakage losses become too great. An alternative for the displacer rod clearance seal K is to employ an abradable surface so that wear-in will occur until the components are self-supporting at which time, wear ceases. The linear alternator/motor 174 and its counter part 176 provide electrical output or mechanical input depending on whether the Stirling machine is an engine or a heat pump.

In all these embodiments of the invention, gas bearings are located at the clearance fit between a piston and its cylinder to provide one support point and a radially acting spring bearing is located along the piston's connecting rod at a distance L from the gas bearings. Although the invention is directed to two bearing supports, one a gas bearing and the other a radially acting spring bearing, bearings can be constructed as a composite of multiple components and still effectively function as a single bearing. For example, radially acting spring bearings, can, and often are, constructed as a composite of multiple, parallel, individual spring bearings placed axially adjacent each other to function as a single composite bearing. For example, FIG. 7 shows a radially acting spring bearing 168 that is formed by three closely spaced, parallel planar spring bearings. Such a composite bearing is considered one bearing when it has a single central or effective point of connection that must be radially adjusted. However, when two or more radially acting spring bearings, whether or not composite, are spaced apart far enough that they require separate mounting and separate alignment procedures, then they are two individual or separate radially acting spring bearings. A radially acting spring bearing is a single bearing if it aligns one point along the axis of reciprocation, regardless of the number of separate spring components that it has. Similarly, the interface between a piston and its cylinder may be maintained in non-contact by two or more axially spaced sets of gas bearing ports, each set spaced circumferentially around the cylindrical face of the piston. However, when there is a close fit clearance between one piston and its cylinder, that is one gas bearing, despite the number and arrangement of gas bearing ports feeding the gas bearing.

FIG. 8 conceptually shows a power piston (or displacer piston) 180 of the proposed invention with its attached connecting rod 182 for purposes of illustrating the geometric parameters of the invention. The piston 180 and connecting rod 182 together, are shown by solid black lines in axial alignment with the axis of the cylinder and are shown by dashed lines rotated in the plane of the figure. The short seal length compared to the distance between the bearing supports allows rotational compliance while still maintaining non-contact operation. This greatly relieves the requirement of precision on the support away from the critical clearance seal so that a simple radially acting spring bearing, with a looser precision, may be used.

The geometric parameters of the invention are used in the following mathematical explanation of desired parameter relationships of preferred embodiments of the invention.

For a small diametrical gap g compared to diameter D and seal length S, the maximum rotation of the piston 180 until contact with the cylinder 184, given by angle α, is to a good approximation:

$$\alpha \approx \frac{S}{2D}\left(1-\sqrt{1-4D\frac{g}{S^2}}\right) \text{ [radians]} \quad \text{(EQ. 1)}$$

The allowable, off-center, radial displacement is A in FIG. 8. There is a point 181 along the axis of the piston 180 that is in a plane oriented perpendicular to the axis 185 of the cylinder 184 and passing through the effective attachment point 187 of the radially acting spring bearing to the connecting rod 182. If that point 181 of connection to the radially acting spring bearing is displaced radially off center from the axis 185 of the piston's cylinder, eventually the points on the piston at the opposite ends of the gas bearing will contact the cylinder. That displacement A is approximately:

$$A = \frac{LS}{2D}\left(1-\sqrt{1-4Dg/S^2}\right) \quad \text{(EQ. 2)}$$

where L is the distance between the bearing supports.

For example, if the piston diametrical clearance gap (g) is 35 μm, the seal length (S) 20 mm, the diameter (D) 50 mm and the distance between the bearing supports (L) 150 mm, then EQ. 2 gives A=0.2637 mm, more than seven times larger than the clearance g. Therefore, the tolerance to which the position of the radially acting spring bearing support must be adjusted is 7 times greater than the clearance g.

For seals that have low leakage losses and therefore provide acceptable performance as a gas bearing and/or a clearance seal, the quantity 4 $Dg/S^2$ is small and this allows the following approximate relationship for the displacement A.

$$A \approx \frac{Lg}{S} \quad \text{(EQ. 3)}$$

Therefore, the preferred distance between the bearing support points should be:

$$L \geq A\frac{S}{g} \quad \text{(EQ. 3A)}$$

Using the example case and (EQ.3), the displacement A=0.2625 mm, which is quite close to the more exact solution. If A is set at some minimum reasonable value, say 0.1 mm, which is considerably greater than the typical diametrical clearance gap, then (EQ. 3) may be used to formulate a requirement for the distance between the bearing supports for practical embodiments of the invention. The result is:

$$L \geq 0.1\frac{S}{g} \quad \text{(EQ. 4)}$$

Where L is in mm and the seal length S and the diameter D of the piston are of similar size. For the purposes of this invention, similar size means that the seal length should be no more than 1.5 times the diameter and no less than 0.3 times the diameter. For typical implementations of the invention, the typical diametrical clearance gap will be in the range of 12 μm to 50 μm.

By arranging bearing supports of the power piston and/or the displacer piston according to the invention, the precision required at attachment to the radially acting spring bearing is greatly reduced. Furthermore, by locating a single gas bearing set at the displacer piston and/or power piston interface with its cylinder, both the precision clearance requirement of the gas bearing and the performance of the machine are met. The invention allows the displacer piston and/or power piston to be made shorter since the working fluid leakage is dominated by the clearance (proportional to the cube of the gap) and only weakly dependent on the length (proportional to the inverse of the length). By shortening the displacer piston and/or power piston seal length compared to the distance between the bearing supports, more angular misalignment may be tolerated. This allows the second support by the radially acting spring bearing to be much more forgiving.

The invention supports a piston-cylinder assembly by means of a gas bearing in the close-fit region while at the other end, some distance from the close-fit, by a radially acting spring bearing support which offers substantial advantages. In this way, the gas bearing provides the non-contact clearance where it is vital and the non-contact radially acting spring bearing provides support where precision is more relaxed. The further the radially acting spring bearing support is from the close-fit region, the less precision required of it. If sufficient precision can be removed from the radially acting spring bearing, then inexpensive fabrication techniques may be employed, such as stamping. By using this technique in a beta configuration free-piston Stirling machine as shown in FIG. 5, the displacer rod clearance fit to the piston may be made more generous since there is no requirement for a gas bearing at this site. Since the invention relies on a two-point support separated from each other sufficiently far to provide the benefits cited, the supported structure is necessarily rigid.

The invention eliminates the need for precision alignment of four points by requiring the alignment of only three points and reduces the degree of precision that is required. As previously explained, the alignment of a piston in a cylinder requires the alignment of two points. One point is the point of intersection of the central axis of the piston with one end of the piston and the second point is the point of intersection of the central axis of the piston with the opposite end of the piston. When the piston is aligned in the cylinder during reciprocation so that both of those two points lie along a line that is parallel to the axis of the cylinder, then the piston is perfectly aligned in the cylinder.

If, in addition to the piston, there is an cylindrical object, such as a connecting rod, that is rigidly connected to the piston and reciprocates within a cylindrical surface, then there are two more points which must be aligned with the first two. If gas bearings and clearance seals are used for both, then both of these two additional points must be aligned with precision with the first two points. Similarly, if, in addition to the piston, there are two additional radially acting spring bearings, then the two additional points for both of these two spring bearings must be radially adjusted. In other words, with a piston and two additional bearings, there are four points that must me brought into alignment.

When there are two additional bearing points to be adjusted, adjusting the alignment of one of the additional points, changes the alignment of the other additional point. So it is difficult at best or impossible to bring all four of the points into simultaneous alignment. Additionally, manufacturing imperfections in alignment (i.e. departures from nominal alignment position and/or orientation) can make it impossible to properly align all four of the points because adjusting the alignment of one additional point to accommodate its alignment imperfection, changes the alignment of the other additional points. Many prior art free piston machines have this problem.

However, with the invention there is only one additional point for a total of only three points to be brought into alignment. Only one requires adjustment. The third alignment point is the connection of the one radially acting spring bearing to the connecting rod. That adjustment is the spacing, in the plane perpendicular to the axis of the cylinder, of the point where the radial spring forces act upon the axis of the piston.

With the invention, the distance from the gas bearing to the radially acting spring bearing is made large enough to tolerate a greater distance of misalignment than in the prior art. In other words, the tolerance for misalignment is greater, making adequate alignment easier and less precise. This allows adequate alignment to be accomplished with parts that are manufactured to greater tolerances, i.e. more imprecision can be tolerated so the parts are less expensive. Increased tolerance (less precision) is acceptable for the radially acting spring and the parts to which it is connected. Importantly, there is only one component, the one radially acting spring bearing, that must be adjusted in order to accomplish non-contact bearing operation of the piston or displacer in the cylinder.

In order to use the invention, the designer can typically begin by determining the clearance g and the clearance seal length S required for the gas bearing clearance seal. These are based upon the usual design parameters, such as power and efficiency. Then, having determined the piston or displacer size and its clearances, the designer determines a desirable tolerance (A or less) for the radial adjustment of the radially acting spring bearing. Finally, the designer determines the distance from the gas bearing to the radially acting spring bearing using (EQ. 3A). Of course a designer may select a different set of the parameters of the design equations and solve for another.

After construction, adjustment begins with positioning the parts and tightening the parts in place in their free position, which is the position they should be in during operation. With the invention, the only adjustment of the bearings is the radial adjustment of the one radially acting spring bearing for each combination piston and its connecting rod. It is adjusted so that the off-center distance is less than or equal to the allowable off-center distance A. This assures that the angle between the axis of the cylinder and the axis of the piston-connecting rod together is less than the angle $\alpha$ which is the maximum angle between those axes without contact of the piston with the wall of its cylinder.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A free-piston Stirling cycle machine having an improved bearing support system, the machine including a casing containing a cylindrical, free, power piston and a displacer piston, each piston having a clearance seal with a seal length and an axial center and reciprocatable in a cylinder mounted to the casing, wherein the improvement comprises:

(a) at least a selected one of the pistons having a seal length in the range of 0.3 times the diameter of the piston to 1.5 times the diameter of the piston;

(b) a non-compliant connecting rod fixed to an end of the selected piston;

(c) the selected piston and connecting rod together being supported in the casing by two bearings which are (i) a gas bearing formed at the interface between the selected piston and its associated cylinder at the piston clearance seal; and (ii) a radially acting spring bearing fixed to the casing and extending to fixed connection to the connecting rod, the distance from the gas bearing to the connection of the radially acting spring bearing to the connecting rod being greater than the seal length of the piston.

2. A free-piston Stirling cycle machine in accordance with claim 1 wherein the distance L from the center of its clearance seal to the fixed connection of the radially acting spring bearing to the connecting rod is $$L \geq A\frac{S}{g}$$

wherein

A is the allowable off-center distance for the radial displacement of the fixed connection of the radially acting spring bearing to the connecting rod;

S is the seal length of the selected piston; and g is the diametrical clearance gap between the selected piston and its associated cylinder.

3. A free-piston Stirling cycle machine in accordance with claim 2 wherein the allowable off-center distance A for the radial displacement of the fixed connection of the radially acting spring bearing to the connecting rod is greater than the diametrical clearance gap g.

4. A free-piston Stirling Cycle machine in accordance with claim 3 wherein the diametrical clearance gap between the selected piston and its cylinder is in the range of 12 μm to 50 μm.

5. A free-piston Stirling Cycle machine in accordance with claim 4 wherein the selected piston is the power piston of the free-piston Stirling machine.

6. A free-piston Stirling Cycle machine in accordance with claim 4 wherein radially acting spring bearing is a planar spring.

7. A free piston Stirling Cycle free-piston machine in accordance with claim 4 wherein the selected piston is the displacer piston of the free-piston Stirling machine.

8. A Stirling Cycle free-piston machine in accordance with claim 7 wherein the radially acting spring bearing is a planar spring.

9. A Stirling Cycle free-piston machine in accordance with claim 1 wherein the selected piston is the power piston of the free-piston Stirling machine, and wherein the displacer piston comprises:

(a) a seal length in the range of 0.3 times the diameter of the displacer piston to 1.5 times the diameter of the displacer piston; and (b) a non-compliant, displacer connecting rod fixed to an end of the displacer piston; and wherein (c) the displacer piston and the displacer connecting rod together are supported in the casing by two bearings which are (i) a gas bearing formed at the interface between the displacer piston and its associated cylinder at a displacer clearance seal; and (ii) a radially acting spring bearing fixed to the casing and extending to fixed connection to the displacer connecting rod, the distance from the gas bearing to the connection of the radially acting spring bearing to the displacer connecting rod being greater than the seal length of the displacer piston.

* * * * *